US011904370B2

(12) United States Patent
Droeschel et al.

(10) Patent No.: US 11,904,370 B2
(45) Date of Patent: Feb. 20, 2024

(54) DRAWING DIE

(71) Applicants: CERATIZIT LUXEMBOURG S.A.R.L, Mamer (LU); CERATIZIT COMO S.P.A., Alserio (IT)

(72) Inventors: Michael Droeschel, Mamer (LU); Antonello Valsecchi, Alserio (IT)

(73) Assignees: CERATIZIT Luxembourg S.A.R.L., Mamer (LU); CERATIZIT Como S.P.A., Alserio (IT)

( * ) Notice: Subject to any disclaimer, the term of this patent is extended or adjusted under 35 U.S.C. 154(b) by 387 days.

(21) Appl. No.: 17/259,654

(22) PCT Filed: Jul. 1, 2019

(86) PCT No.: PCT/EP2019/067523
§ 371 (c)(1),
(2) Date: Jan. 12, 2021

(87) PCT Pub. No.: WO2020/011575
PCT Pub. Date: Jan. 16, 2020

(65) Prior Publication Data

US 2021/0323040 A1 Oct. 21, 2021

(30) Foreign Application Priority Data

Jul. 12, 2018 (EP) ..... 18183224

(51) Int. Cl.
*B21C 3/02* (2006.01)
*C22C 29/08* (2006.01)
*C22C 32/00* (2006.01)

(52) U.S. Cl.
CPC ..... *B21C 3/02* (2013.01); *C22C 29/08* (2013.01); *C22C 32/0026* (2013.01)

(58) Field of Classification Search
CPC ..... B21C 3/02; C22C 29/08; C22C 32/0026
See application file for complete search history.

(56) References Cited

U.S. PATENT DOCUMENTS

| | | | |
|---|---|---|---|
| 4,820,482 | A | 4/1989 | Fischer et al. |
| 5,421,852 | A | 6/1995 | Maruyama et al. |
| 6,086,650 | A | 7/2000 | Carpenter |
| 6,464,748 | B2 | 10/2002 | Perez et al. |

(Continued)

FOREIGN PATENT DOCUMENTS

| | | | |
|---|---|---|---|
| CN | 103173673 | A | 6/2013 |
| EP | 0559901 | A1 | 9/1993 |

(Continued)

OTHER PUBLICATIONS

2) Leif Lindholm et.al [EP0028620B1] (Year: 1980).*

*Primary Examiner* — Brian D Walck
*Assistant Examiner* — Nazmun Nahar Shams
(74) *Attorney, Agent, or Firm* — Laurence A. Greenberg; Werner H. Stemer; Ralph E. Locher

(57) ABSTRACT

A drawing die made from cemented carbide material is formed of tungsten carbide and a metallic binder. The cemented carbide material includes: tungsten carbide with an average grain size of 0.15-1.3 μm, 0.5-5.0 wt.-% (Co+Ni), with a ratio Co/(Co+Ni) of 0.6-0.9; 0.1-1.0 wt.-% Cr, with $0.05 \leq Cr/(Co+Ni) \leq 0.22$; 0.02-0.2 wt.-% Mo; and 0-0.04 wt.-% V. The cemented carbide material is substantially free from η-phase.

10 Claims, 2 Drawing Sheets

(56) References Cited

U.S. PATENT DOCUMENTS

| | | | | |
|---|---|---|---|---|
| 9,127,335 | B2 | 9/2015 | Ederyd | |
| 2002/0059849 | A1* | 5/2002 | Perez | C22C 29/08 75/240 |
| 2012/0093597 | A1* | 4/2012 | Ederyd | C22C 29/08 72/274 |

FOREIGN PATENT DOCUMENTS

| | | | |
|---|---|---|---|
| EP | 1327007 | B1 | 12/2004 |
| JP | S61110745 | A | 5/1986 |
| JP | S6324032 | A | 2/1988 |
| JP | 2009114469 | A | 5/2009 |
| WO | 0000655 | A1 | 1/2000 |
| WO | 2010126424 | A1 | 11/2010 |

* cited by examiner sample B sample E

DRAWING DIE

BACKGROUND OF THE INVENTION

Field of the Invention

The present invention relates to a drawing die made from cemented carbide material, in particular to a drawing die for drawing steel wire.

Drawing dies are used in the manufacturing of wire for several applications. Tools for wire drawing must exhibit high hardness and wear resistance to bring an economical advantage to the user. Drawing dies for drawing wire from metallic material, in particular for drawing steel wire, are often made from cemented carbide material the main constituent of which is tungsten carbide (WC). Cemented carbide is a composite material in which voids between the WC grains are filled by a ductile metallic material which in most cases is formed by cobalt (Co).

EP 1 327 007 B1 describes drawing dies made from cemented carbide having a binder phase consisting of cobalt (Co) and nickel (Ni) and having a structure containing a high amount of 1-5 vol.-% of finely distributed eta phase (η-phase).

To improve productivity in the process of wire drawing, the drawing dies used in this process are subjected to more and more severe conditions. The failure mode for such tools is not limited to mechanical wear but is also related to corrosion due to interaction with the worked material and the lubricants used in the process. Further, the occurring high local temperature in the contact area between the die and the wire does also contribute to accelerate the corrosion mechanism. Additionally, a high value of fracture toughness is required in some applications where the high hardness of the worked material brings critical values of stress on the drawing tool. As a consequence of this, besides the demand for the material of the drawing dies to have a high hardness which has been the predominant requirement in the past, there exists an increasing demand to also improve other characteristics of the drawings dies such as the corrosion resistance and the toughness. Standard strategies to improve the corrosion resistance of carbide grades often bring a lowering of fracture toughness due to a different binder composition.

SUMMARY OF THE INVENTION

It is the object of the present invention to provide a drawing die made from cemented carbide material having a high hardness and at the same time an improved corrosion resistance and toughness.

This object is solved by a drawing die as claimed. Further developments are defined in the dependent claims.

The drawing die is made from cemented carbide material comprising tungsten carbide and a metallic binder. The cemented carbide material comprises: tungsten carbide with a mean grain size of 0.15-1.3 μm; 0.5-5.0 wt.-% (Co+Ni), with a ratio Co/(Co+Ni) of 0.6-0.9; 0.1-1.0 wt.-% Cr, with $0.05 \leq Cr/(Co+Ni) \leq 0.22$; 0.02-0.2 wt.-% Mo; and 0-0.04 wt.-% V. The cemented carbide material is substantially free from η-phase. Preferably, the cemented carbide material can comprise only this composition plus unavoidable impurities, i.e. essentially consist of this composition. It has surprisingly been found that drawing dies made from such a cemented carbide material do not only have a high hardness but do also show an improved corrosion resistance and toughness. The Co—Ni mixed binder with the Co/(Co+Ni) ratio as defined achieves particularly good balancing of, on the hand, the wettability of the tungsten carbide grains by the binder and, on the other hand high corrosion resistance. Further, significantly improved fracture toughness is achieved which is believed to be due to the absence of significant amounts of both η-phase and vanadium. The ratios Co/(Co+Ni) and Cr/(Co+Ni) are determined based on wt.-%.

According to a further development the cemented carbide material has a hardness HV10 that fulfills the formula: $HV10 \geq 2430-200*wt.-\% (Co+Ni)$. The Vickers hardness HV10 is determined according to DIN ISO 3878:1991 ("Hardmetals-Vickers hardness test"). This high hardness in relation to the content of the metallic binder makes the cemented carbide material particularly suitable for very demanding wire drawing applications. The hardness HV10 can preferably also fulfill the formula: $HV \leq 2905-200*wt.-\% (Co+Ni)$.

According to a further development the cemented carbide material has a fracture toughness $K_{IC}$, as determined by the Palmqvist method according to ISO 28079:2009 that fulfills the formula: $K_{IC} \geq 0.45+1.7*(wt.-\% (Co+Ni))$. The high fracture toughness in this range allows reliable use of the drawing die also in the case of high hardness of the worked material in a wire drawing application. The fracture toughness $K_{IC}$ can preferably be in the band delimited by $K_{IC}$ $[MPa/\sqrt{m}] \leq 4.24+1.7*(wt.-\% (Co+Ni))$.

According to a further development the tungsten carbide has a mean grain size of 0.4-1.3 μm. The mean grain size can be 0.5-0.8 μm, which has proven particularly advantageous in terms of the balance of hardness and toughness.

If the ratio Co/(Co+Ni) is 0.7-0.8, the balance between wettability of the tungsten carbide grains by the binder and corrosion resistance is particularly good.

According to a further development the Mo content is 0.03-0.08 wt.-% of the cemented carbide. This allows a particularly good control of grain size of the tungsten carbide grains and corrosion resistance of the cemented carbide at elevated working temperatures.

If the cemented carbide material comprises 2.0-5.0 wt.-% (Co+Ni), the drawing die is particularly well-suited for demanding drawing operations, as both a too high brittleness and a too low hardness are reliably prevented.

According to a further development the cemented carbide material comprises less than 0.03 wt.-% V. This ensures a high level of fracture toughness of the cemented carbide material.

According to a further development the drawing die is a drawing die for steel cord drawing. It has been found that the drawing dies from the cemented carbide material according to the present invention are particularly well-suited for this application.

According to a further development the relation Cr/(Co+Ni) fulfills $0.05 \leq Cr/(Co+Ni) \leq 0.17$.

Further advantages and further development will become apparent from the following description of embodiments with reference to the enclosed drawings.

DETAILED DESCRIPTION OF THE INVENTION

An embodiment will now be described with reference to the figures.

Figure 1:
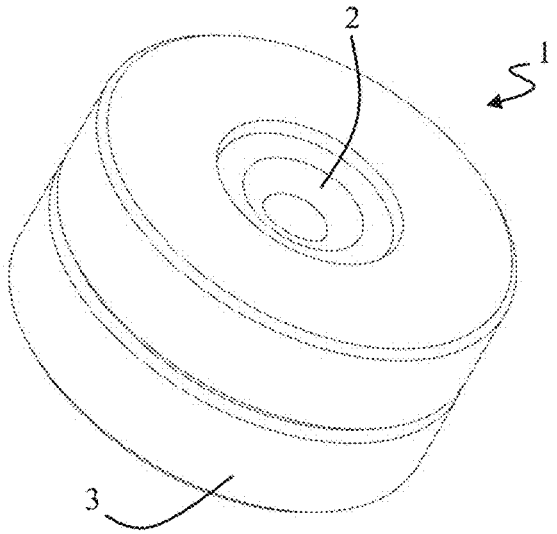
FIG. 1: is a schematic illustration of a drawing die tool comprising a cemented carbide drawing die according to an embodiment cased in a steel casing.

A drawing die tool 1 according to an embodiment is shown in FIG. 1. The drawing die tool 1 comprises a drawing die 2 made from cemented carbide material which is cased in a steel casing 3. The drawing die 2 (often referred to as a drawing die nib) is a wear-resistant forming insert which comes into direct contact with the material of the wire to be formed in a drawing operation. In the specific embodiment, the drawing die tool 1 is designed for steel cord drawing.

Figure 2:
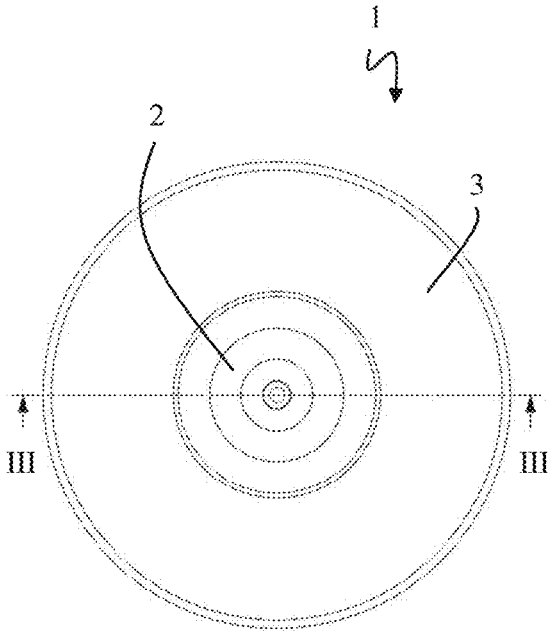
FIG. 2: is a schematic top view of the drawing die tool of FIG. 1.
Figure 3:
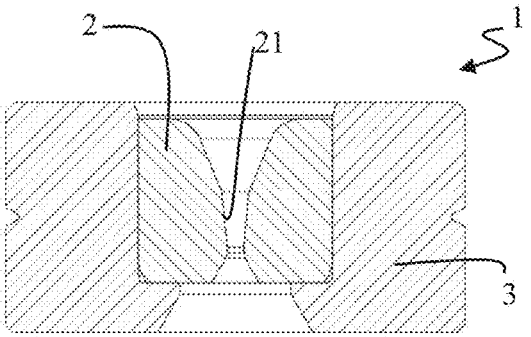
FIG. 3: is a schematic cross-sectional view of the drawing die tool along III-III in FIG. 2.

Although an arrangement of the drawing die 2 in a very specific drawing die tool 1 is shown in FIG. 1 to FIG. 3, other realizations of a casing arrangement are also possible.

The drawing die 2 has an internal forming surface 21 which is configured to contact the material to be worked during the drawing process. The drawing die tool 1 according to the embodiment is adapted for steel cord drawing.

The drawing die 2 is made from cemented carbide material having a specific composition, as will be explained in the following.

The drawing die 2 according to the invention is made from a fine-grained cemented carbide material comprising tungsten carbide (WC) having an average grain size of 0.15-1.3 μm and a ductile metallic binder. Preferably, the tungsten carbide can have an average grain size in the range of 0.4-1.3 μm, more preferably of 0.5-0.8 μm. The cemented carbide material has a mixed metallic binder comprising Co and Ni as the main constituents. The combined amount of Co and Ni of the cemented carbide material is in the range of 0.5-5.0 wt.-%. Preferably, the combined amount of Co and Ni (i.e. the (Co+Ni content) is in the range of 2.0-5.0 wt.-% of the cemented carbide material. The respective amounts of Co and Ni are chosen such that the ratio (in wt.-%) Co/(Co+Ni) is in the range 0.6-0.9, i.e. the amount of Co is substantially larger than the amount of Ni. Preferably, the Co and Ni content can be selected such that the ratio Co/(Co+Ni) is in the range 0.7-0.8. Furthermore, the cemented carbide material has a Cr content of 0.1-1.0 wt.-%. In particular, the amount of Cr is selected such that the following relation (in wt.-%) is fulfilled: $0.05 \leq Cr/(Co+Ni) \leq 0.22$. Preferably the relation $0.05 \leq Cr/(Co+Ni) \leq 0.17$ can be fulfilled. In doing so, an advantageous grain refining effect can be achieved and undesired precipitation of $Cr_3C_2$ can be reliably prevented.

Further, the cemented carbide material comprises a Mo content in the range of 0.02-0.2 wt.-% of the cemented carbide material. The production process of the cemented carbide material is carefully controlled such that the cemented carbide material is at least substantially free from η-phase. Substantially free from η-phase means an amount of 0 to less than 0.5 vol.-% η-phase. The presence of η-phase, i.e. brittle mixed $(W_x, Co_y)_zC$ phases, would lead to an undesired decrease in hardness and/or fracture toughness. The substantial absence of η-phase can be realized by controlling the carbon balance during the production process of the cemented carbide material, as is well known in the art.

The cemented carbide material further comprises substantially no V (Vanadium), in any case less than 0.04 wt.-% V. In particular, the cemented carbide material should preferably contain no V, except for unavoidable contaminations. Preferably, the cemented carbide material contains at least less than 0.03 wt.-% V.

The cemented carbide material according to the invention was produced by powder metallurgy methods using different WC powders having particle sizes (Fisher sieve sizes; FSSS) of 0.75 μm, 2.85 μm, 1.00 μm and 0.6 μm respectively, Co powder having an FSSS particle size of 0.8 μm, Ni powder having an FSSS particle size of 2.25 μm, $Cr_3C_2$ powder having an FSSS particle size of 1.5 μm, $Cr_2N$ powder having an FSSS particle size of 1.5 μm, $Mo_2C$ powder having an FSSS particle size of 1.5 μm; and (for the comparative examples) VC powder having an FSSS particle size of 1 μm, by mixing the respective powders in a solvent in a ball-mill/attritor and subsequent spray-drying in a conventional manner. The resulting granulate was compacted and shaped into the desired shape and was subsequently sintered in a conventional manner in order to obtain the cemented carbide material. Steel wire drawing dies having different internal diameters were manufactured from the cemented carbide material and subsequently tested.

The mean grain size of the tungsten carbide grains in the cemented carbide material was determined according to the "equivalent circle diameter (ECD" method from EBSD (electron backscatter diffraction) images. This method is e.g. described in "Development of a quantitative method for grain size measurement using EBSD", Master of Science Thesis, Stockholm 2012, by Fredrik Josefsson.

Example 1

Several drawing dies 2 for steel cord drawing with inner diameters between 0.1 and 1.2 mm were manufactured in the powder metallurgy production process as described above.

Figure 4:
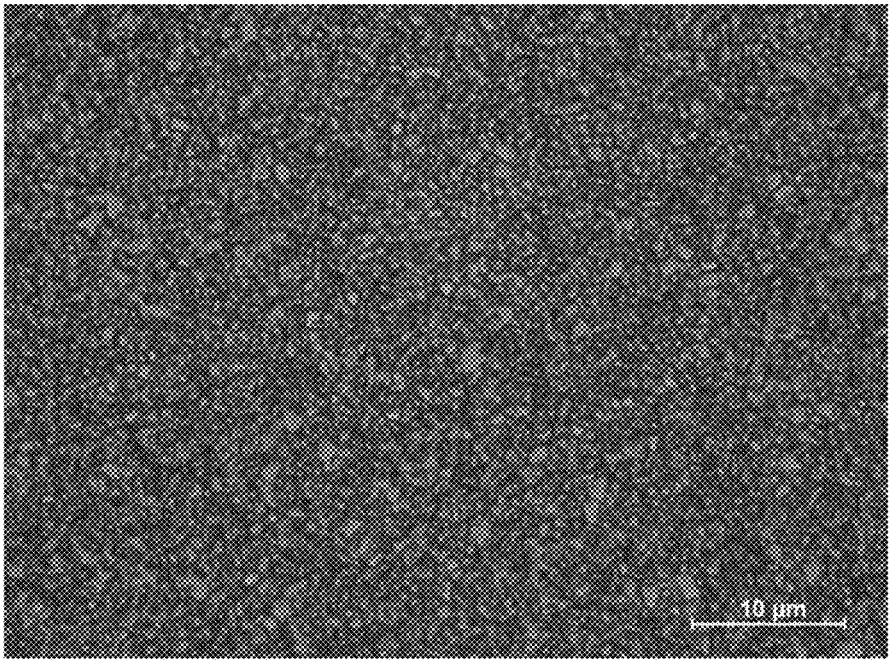
FIG. 4: is a light microscope image of a Sample B.

Cemented carbide drawing dies 2 according to a sample B were produced having the following composition of the cemented carbide material: 2.25 wt.-% Co, 0.75 wt.-% Ni, 0.26 wt.-% Cr (corresponding to 0.3 wt.-% $Cr_2N$ powder), 0.05 wt.-% Mo, rest tungsten carbide and unavoidable impurities. In this case the WC powder with an FSSS particle size of 0.75 μm was used. The carbon balance during the production process was controlled such that no r-phase could be detected in cemented carbide material. The average grain size of the tungsten carbide grains in the cemented carbide material was in the range of 0.5-0.8 μm. A Vickers hardness HV of 2060 was measured. Further, a fracture toughness $K_{IC}$ of 7.5 MPa/√m was measured. A light microscope image of sample B is shown in FIG. 4.

As a first comparative sample A, drawing dies were manufactured from a cemented carbide material having the composition 3.3 wt.-% Co, 0.35 wt.-% Cr (corresponding to 0.4 wt.-% $Cr_2N$), 0.12 wt.-% V (corresponding to 0.15 wt.-% VC), rest tungsten carbide and unavoidable impurities. In this case the WC powder with an FSSS particle size of 1.0 μm was used. The resulting average grain size of the tungsten carbide grains in the cemented carbide material was in the range of 0.5-0.8 μm. Again, the carbon balance was controlled such that no η-phase could be detected in the cemented carbide material. A Vickers hardness HV10 of 2020 was measured and a fracture toughness $K_{IC}$ of 6.5 MPa/√m.

It can be seen that sample B shows a significantly higher fracture toughness $K_{IC}$ as compared to comparative sample A. Corrosion tests were performed and a substantially increased corrosion resistance was found in sample B as compared to comparative sample A.

The drawing dies were tested under the following conditions:

Worked material: high carbon steel wire (0.75 wt.-% C), tensile strength 2500-3500 MPa, brass coated Drawing speed: 10-20 m/s A performance factor relating to the quantity of wire as length of mass drawn through the different drawing dies according to sample B and according to first comparative sample A were determined with the following results:

Performance factor of comparative sample A: 1.0

Performance factor of sample B: 2.5

Thus, it can be seen that a significantly improved performance was achieved with sample B as compared to comparative sample A.

Example 2

As second comparative sample D, drawing dies were manufactured from a cemented carbide material having the composition 6.5 wt.-% Co, 0.26 wt.-% Cr (corresponding to 0.3 wt.-% $Cr_3C_2$), 0.36 wt.-% V (corresponding to 0.45 wt.-% VC), rest tungsten carbide and unavoidable impurities. In this case the WC powder with an FSSS particle size of 0.6 μm was used The resulting average grain size of the tungsten carbide grains was in the range of 0.2-0.5 μm. Again, the carbon balance was controlled such that no η-phase could be detected in the cemented carbide material. A Vickers hardness HV10 of 2030 was measured and a fracture toughness $K_{IC}$ of 7.2 MPa/√m.

It can be seen that comparative sample D shows a lower fracture toughness as compared to sample B above. Corrosion tests were performed and it was found that sample B above shows a significantly higher corrosion resistance.

The drawing dies according to second comparative sample D and the drawing dies according to sample B from above were tested under the following conditions:

Worked material: high carbon steel wire (0.75 wt.-% C), tensile strength 2500-3500 MPa, brass coated Drawing speed: 10-20 m/s The performance factors were determined similar to EXAMPLE 1 above with the following results:

Performance factor of comparative sample D: 1.0

Performance factor of sample B: 3.0

Thus, it can be seen that a significantly improved performance was achieved with sample B as compared to comparative sample D.

Example 3

Drawing dies for steel wire drawing operations with an inner diameter between 0.8 and 2.5 mm were manufactured.

Figure 5:
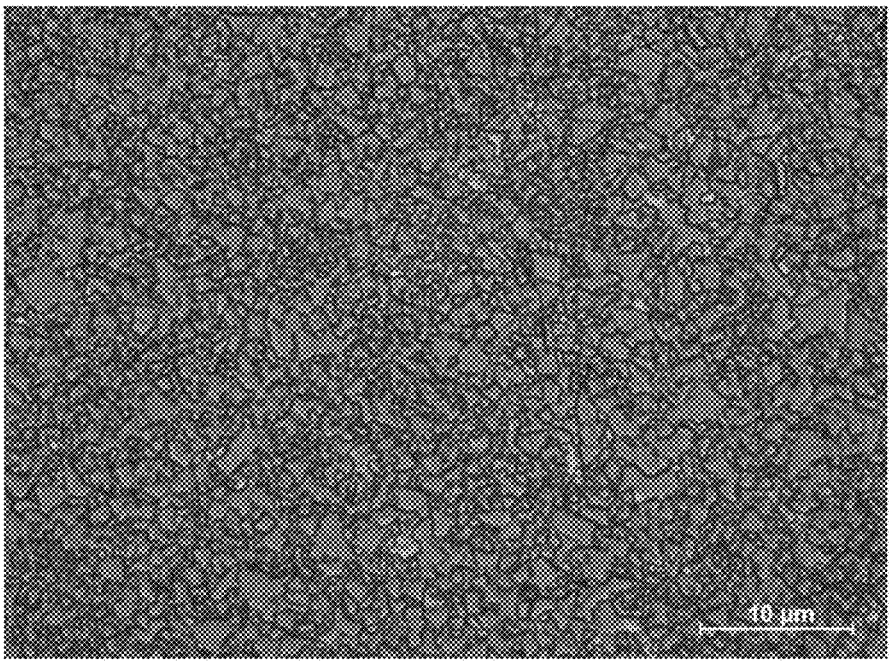
FIG. 5: is a light microscope image of a Sample E.

Cemented carbide drawing dies 2 according to a sample E were produced having the following composition of the cemented carbide material: 3 wt.-% Co; 1 wt.-% Ni; 0.35 wt.-% Cr (corresponding to 0.4 wt.-% CrN); 0.05 wt.-% Mo, rest tungsten carbide and unavoidable impurities. In this case the WC powder with an FSSS particle size of 2.85 μm was used. The carbon balance during the production process was controlled such that no η-phase could be detected in cemented carbide material. The average grain size of the tungsten carbide grains in the cemented carbide material was in the range of 0.8-1.3 μm. A Vickers hardness HV of 1780 was measured. Further, a fracture toughness $K_{IC}$ of 10.1 MPa/√m was measured. A light microscope image of sample E is shown in FIG. 5.

As a third comparative sample F drawing dies were manufactured from a cemented carbide material having the composition 6 wt.-% Co, 0.53 wt.-% Cr (corresponding to 0.6 wt.-% CrN), 0.15 wt.-% V (corresponding to 0.18 wt.-% VC), rest tungsten carbide and unavoidable impurities. In this case the WC powder with an FSSS particle size of 1.0 μm was used. The resulting average grain size of the tungsten carbide grains in the cemented carbide material was in the range of 0.5-0.8 μm. Again, the carbon balance was controlled such that no η-phase could be detected in the cemented carbide material. A Vickers hardness HV10 of 1820 was measured and a fracture toughness $K_{IC}$ of 8.2 MPa/√m.

It can be seen that comparative sample F shows a lower fracture toughness as compared to sample E. Corrosion tests were performed and it was found that sample E shows a significantly higher corrosion resistance as compared to comparative sample F.

The drawing dies according to sample E and the drawing dies according to the comparative sample F were tested under the following conditions:

Worked material: free-cutting carbon steel wire (1.0 wt.-% C, 0.2 wt.-% Pb), tensile strength 950 MPa, Drawing speed: 5 m/s The performance factors were determined similar to EXAMPLE 1 above with the following results:

Performance factor of comparative sample F: 1.0

Performance factor of sample E: 1.8

Thus, it can be seen that a significantly improved performance was achieved with sample E as compared to comparative sample F.

The invention claimed is:

1. A drawing die tool, comprising:

a drawing die of cemented carbide material comprising tungsten carbide and a metallic binder;

the cemented carbide material containing:

tungsten carbide having a mean grain size of 0.15-1.3 μm;

cobalt (Co) and nickel (Ni), with 0.5-5.0 wt.-% (Co+Ni), and with a ratio Co/(Co+Ni) of 0.6-0.9;

0.1-1.0 wt.-% chromium (Cr), with 0.05<Cr/(Co+Ni)<0.22;

0.03-0.08 wt.-% wt.-% molybdenum (Mo); and 0-0.04 wt.-% vanadium (V); and the cemented carbide material being substantially free from η-phase.

2. The drawing die tool according to claim 1, wherein the cemented carbide material has a hardness HV10 that satisfies the following formula:

$$HV10>2430-200*wt.-\%\ (Co+Ni):$$

3. The drawing die tool according to claim 1, wherein the cemented carbide material has a fracture toughness KIC, as determined by the Palmqvist method according to ISO 28079:2009 that satisfies the following formula:

$$KIC\ [MPa/\sqrt{m}]>0.45+1.7*(wt.-\%\ (Co+Ni)):$$

4. The drawing die tool according to claim 1, wherein the tungsten carbide has a mean grain size of 0.4-1.3 μm.

5. The drawing die tool according to claim 4, wherein the tungsten carbide has a mean grain size of 0.5-0.8 μm.

6. The drawing die tool according to claim 1, wherein the ratio Co/(Co+Ni) is 0.7-0.8.

7. The drawing die tool according to claim 1, wherein the cemented carbide material comprises 2.0-5.0 wt.-% (Co+Ni).

8. The drawing die tool according to claim 1, wherein the cemented carbide material comprises less than 0.03 wt.-% V.

9. The drawing die tool according to claim 1, wherein the drawing die is a drawing die configured for steel cord drawing.

10. The drawing die tool according to claim 1, wherein $0.05<Cr/(Co+Ni)<0.17$.

* * * * *